US008348555B2

(12) United States Patent
Stoetzer et al.

(10) Patent No.: US 8,348,555 B2
(45) Date of Patent: Jan. 8, 2013

(54) FORMWORK ELEMENT FOR BOUNDING A TRENCH WALL SECTION, FORMWORK PART AND METHOD FOR PRODUCING A TRENCH WALL IN THE GROUND

(75) Inventors: Erwin Emil Stoetzer, Aichach (DE); Franz Werner Gerressen, Schrobenhausen (DE); Roland Wenger, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 891 days.

(21) Appl. No.: 12/078,718

(22) Filed: Apr. 3, 2008

(65) Prior Publication Data

US 2008/0265126 A1 Oct. 30, 2008

(30) Foreign Application Priority Data

Apr. 20, 2007 (EP) ..... 07008140

(51) Int. Cl.
*E02D 17/08* (2006.01)

(52) U.S. Cl. ..... 405/282; 52/584.1

(58) Field of Classification Search ..... 405/282, 405/283, 272; 52/396.02, 396.05, 395, 223.5, 52/223.7, 582.1, 584.1, 585.1
See application file for complete search history.

(56) References Cited

U.S. PATENT DOCUMENTS

| | | | | | |
|---|---|---|---|---|---|
| 2,423,695 | A | * | 7/1947 | Falco | 52/601 |
| 2,751,776 | A | * | 6/1956 | Streblow et al. | 52/223.7 |
| 2,961,731 | A | * | 11/1960 | Buzzell et al. | 264/35 |
| 2,971,295 | A | * | 2/1961 | Reynolds | 52/223.7 |
| RE25,102 | E | * | 12/1961 | Buzzell et al. | 264/35 |
| 3,350,828 | A | * | 11/1967 | Russell | 52/395 |
| 3,432,978 | A | * | 3/1969 | Erickson | 52/223.7 |
| 3,750,410 | A | * | 8/1973 | Converse | 405/272 |
| 4,068,482 | A | * | 1/1978 | Hilfiker | 405/272 |
| 4,285,180 | A | * | 8/1981 | Hinton et al. | 52/396.03 |
| 4,345,857 | A | * | 8/1982 | Krings | 405/282 |
| 4,357,784 | A | * | 11/1982 | Grady, II | 52/584.1 |
| 4,372,709 | A | * | 2/1983 | Krings | 405/282 |
| 4,616,959 | A | * | 10/1986 | Hilfiker | 405/286 |
| 5,516,238 | A | * | 5/1996 | Beury | 405/282 |
| 6,173,937 | B1 | * | 1/2001 | Cottongim | 249/40 |
| 6,213,688 | B1 | * | 4/2001 | Donkersloot, Sr. | 405/284 |
| 6,240,693 | B1 | * | 6/2001 | Komasara et al. | 52/439 |
| 6,371,699 | B1 | * | 4/2002 | Weinreb | 405/262 |
| 6,981,686 | B2 | * | 1/2006 | McGuinness | 249/48 |
| 7,062,885 | B1 | * | 6/2006 | Dickenson, Jr. | 52/293.3 |
| 7,661,908 | B1 | * | 2/2010 | Kundel, Sr. | 405/274 |

FOREIGN PATENT DOCUMENTS

| | | | | |
|---|---|---|---|---|
| DE | 1913764 | B1 | | 7/1970 |
| DE | 9001679 | U1 | | 6/1991 |
| DE | 9311946 | U1 | | 10/1993 |
| EP | 0440584 | A | | 8/1991 |
| EP | 0531600 | A1 | | 3/1993 |
| JP | 55145213 | A | * | 11/1980 |
| JP | 59233016 | A | * | 12/1984 |
| JP | 05187022 | A | * | 7/1993 |

* cited by examiner

*Primary Examiner* — Michael Safavi
(74) *Attorney, Agent, or Firm* — Jacobson Holman PLLC

(57) ABSTRACT

The present invention relates to a shuttering element for limiting a section of a trench wall. The shuttering element is characterized by a plurality of shuttering parts which have a plate-shaped base body, consisting of concrete in particular, and are connected to one another at their adjoining horizontal front faces. Furthermore, the invention relates to a shuttering part as well as a method for producing a trench wall in the ground.

12 Claims, 2 Drawing Sheets

FORMWORK ELEMENT FOR BOUNDING A TRENCH WALL SECTION, FORMWORK PART AND METHOD FOR PRODUCING A TRENCH WALL IN THE GROUND

BACKGROUND OF THE INVENTION

1. Field of the Invention

The present invention relates in a first aspect to a formwork element for bounding a trench wall section of a trench wall.

In another aspect the invention relates to a formwork part which is in particular adapted to form a formwork element according to the invention.

Finally, the invention relates to a method for producing a trench wall in the ground, in which trench wall sections lying next to each other are formed in the ground by means of a trench wall device, in particular by a trench wall cutter, wherein at least one trench wall section is bounded by an introduced formwork element.

2. Description of Related Art Including Information Disclosed Under 37 CFR §§1.97 and 1.98

A generic formwork element and a generic method are known for instance from DE 90 01 679 U1.

It is known to employ formwork elements, such as e.g. stop-end tubes made of steel, in order to limit sections of a trench wall that are to be produced of concrete. The width or diameter of such formwork elements that are lowered into the construction joint prior to concreting corresponds to the thickness of the trench wall. Following the setting of the concrete these formwork elements have to be removed, for example by being drawn vertically upwards out of the construction joint by means of hydraulic devices. As it proves to be quite difficult to determine the point of setting of the concrete that is most favourable for withdrawal this frequently leads to situations in which the concrete has set either to an insufficient degree or else has hardened too much. In the first case parts of the freshly concreted trench wall cave in during withdrawal of the formwork elements and in the second case withdrawal of the formwork elements is considerably difficult and, in some cases, even impossible.

In order to avoid these difficulties prefabricated elements are also used in the prior art for bounding trench wall sections which remain in the ground after concreting the respective trench wall sections. Such prefabricated elements can be made of steel or concrete for example. In larger trench wall depths, however, such components are extremely bulky due to their weight. In addition, in the case of formwork elements made of concrete these must have hardened very well so as to avoid damage, which results in a very long storage time. Due to the sensitivity of concrete in regard to tensile loads are concerned, such formwork components of concrete typically need to have hardened for approximately four weeks.

BRIEF SUMMARY OF THE INVENTION

The object of the invention is to provide a formwork element which is especially easy to install. Furthermore, a method for producing a trench wall in the ground is to be provided with which it is possible to bound a trench wall section in an uncomplicated manner.

In a first aspect of the invention the object is solved by a formwork element comprising a plurality of concrete formwork parts which have a plate-shaped base body, and are connected to one another at their adjoining horizontal end faces; and by a formwork part for forming a formwork element, comprising a plate-shaped base body, consisting of concrete in particular, and a connecting device arranged on at least one horizontal end face of the base body for connecting a further formwork part.

As far as the method is concerned the object is solved by a method for producing a trench wall in the ground, in which trench wall sections lying next to each other are formed in the ground by means of a trench wall device, in particular by a trench wall cutter, wherein at least one trench wall section is bounded by an introduced formwork element, wherein the formwork element is composed of individual formwork parts that are introduced successively into the trench and connected to one another at their horizontal end faces.

In accordance with the invention the formwork element of the above-stated kind comprises a plurality of formwork parts which have a plate-shaped base body, consisting of concrete in particular, and are connected to one another at their adjoining horizontal end faces.

The formwork part according to the invention, which is adapted in particular to form a formwork element in accordance with the invention, has a plate-shaped base body, consisting of concrete in particular, wherein on at least one horizontal end face of the base body a connecting device is arranged for connecting a further formwork part.

According to the invention the method of the above-stated kind is developed further in that the formwork element is composed of individual formwork parts that are introduced successively into the trench and connected to one another at their horizontal end faces.

The central idea of the invention can be seen in the fact that the formwork element no longer consists of one part, as is the case in prior art, but is composed of several formwork parts or formwork segments.

A first considerable advantage resides in this connection in the fact that these formwork parts are much smaller for example as formwork elements for trench walls of very large depths. This brings about substantial advantages with regard to handling and processing of the formwork elements and formwork parts.

According to another central idea of the invention the formwork parts according to the invention have suitable connecting devices at their horizontal end faces so that single formwork parts can be connected to one another.

Another advantage of the invention can be seen in the fact that due to their smaller size the formwork parts are exposed to a considerably lower amount of stress during assembly as well as during movement and transport prior to the assembly as compared to a large formwork element consisting of one piece. If the formwork parts are produced of concrete, noticeably shorter hardening times are already sufficient. First tests have shown that in formwork parts having a length of approximately 6 m the concrete has hardened to a sufficient degree even after two days.

Finally, an advantage of the invention resides in the fact that it is possible to divide trench walls with different depths with the same formwork parts. Therefore, the production of formwork elements matching the trench wall depth demanded in each case is no longer required.

In principle, the formwork parts can be produced of any chosen kind of material that has the properties suitable with regard to permanent presence in the trench wall. For example the formwork parts can consist of steel. However, it is especially preferred that the base bodies of the formwork parts are produced of concrete.

Accordingly, the invention relates to a formwork element for bounding a trench wall section, wherein the formwork elements consist of individual sections that can be connected to one another by threaded bars. The connecting surfaces located at the end face can be designed as steel plates in order to ensure an axially precise connection of the individual parts and allow for the installation of sealing elements. For this purpose a vertical sealing tape or joint-sealing tape can also be placed in an overlapping manner at points of contact of the formwork element sections and can be connected to one another. After a short storage time when the concrete has gained sufficient stability the formwork elements can be placed vertically into the trench, and in doing so they can first be retained on the guiding wall by means of an axis running through a transverse borehole so as to establish a connection to the next formwork part and seal the points of contact.

Through the invention a formwork element is provided that can remain in the trench wall and yet requires a very short production time until the concrete has the stability needed. Moreover, through the formwork element according to the invention assurance is made that in the case of a small trench wall width and a large trench depth the formwork element does not deform, as is commonly with steel boards, so that sufficient sealing cannot be ensured.

In all, the formwork element according to the invention permits a better and more precise sealing at a smaller trench width. The formwork element remains in the trench and does not have to be cleaned after each use as is common for steel boards.

For best suitability connecting devices are arranged in the portion of the end faces of the formwork parts, by which the formwork parts can be connected to one another in a fixed manner. These connecting devices can each comprise screw connections for example. To this end suitable recesses can be formed in the concrete base body. By the connecting devices a safe mechanical connection of the formwork parts amongst themselves is ensured.

For a great number of applications, for example when trench walls have to be installed below ground-water level, the trench wall needs to be watertight in its entirety. To this end special care is to be taken to ensure that the transition area between the formwork element according to the invention that has already hardened and the later hardening concrete in the adjoining trench wall section is sealed.

For this purpose a joint-sealing tape can be arranged along at least one longitudinal side of the formwork parts which is directed towards the bounding trench wall section.

In order to also ensure a reliable sealing of the portion in which the joint-sealing tapes of adjoining formwork parts make contact the joint-sealing tapes of adjoining and mutually connected formwork parts are preferably connected to each other in a tight manner by means of connecting pieces.

In a simple variant the connecting pieces can be designed as metal clamps, and in particular they can be metal plates that are arranged on opposite sides of the joint-sealing tapes and are connected to each other in a suitable way, for example by being screwed to each other.

Finally, if the trench wall is to be watertight in its entirety, the portion in which the horizontal end faces of two adjoining formwork parts make contact on each other equally needs to be sealed. To this end the portions between adjoining formwork parts, in particular also any connecting pieces that are possibly present, can be filled on the one hand with a sealing compound. This compound can be applied to the respective end faces just before two formwork parts are placed on top of each other and tied together.

However, in especially preferred embodiment variants a seal is provided on at least one horizontal end face of the formwork part for sealing with respect to a subsequent formwork part.

For example such a seal can be formed by a steel plate and a rubber plate fixed thereon. The steel plate can be welded to a steel reinforcement of the concrete base body.

Moreover, in another particularly preferred variant a holding device, in particular a horizontal opening, is provided in the formwork part according to the invention. By such a holding device the handling, i.e. the transport and manipulation of the formwork part according to the invention is facilitated.

BRIEF DESCRIPTION OF THE SEVERAL VIEWS OF THE DRAWINGS

Further advantages and features of the invention are described in the following with reference to the accompanying schematic Figure, wherein.

DETAILED DESCRIPTION OF THE INVENTION

Figure 1:
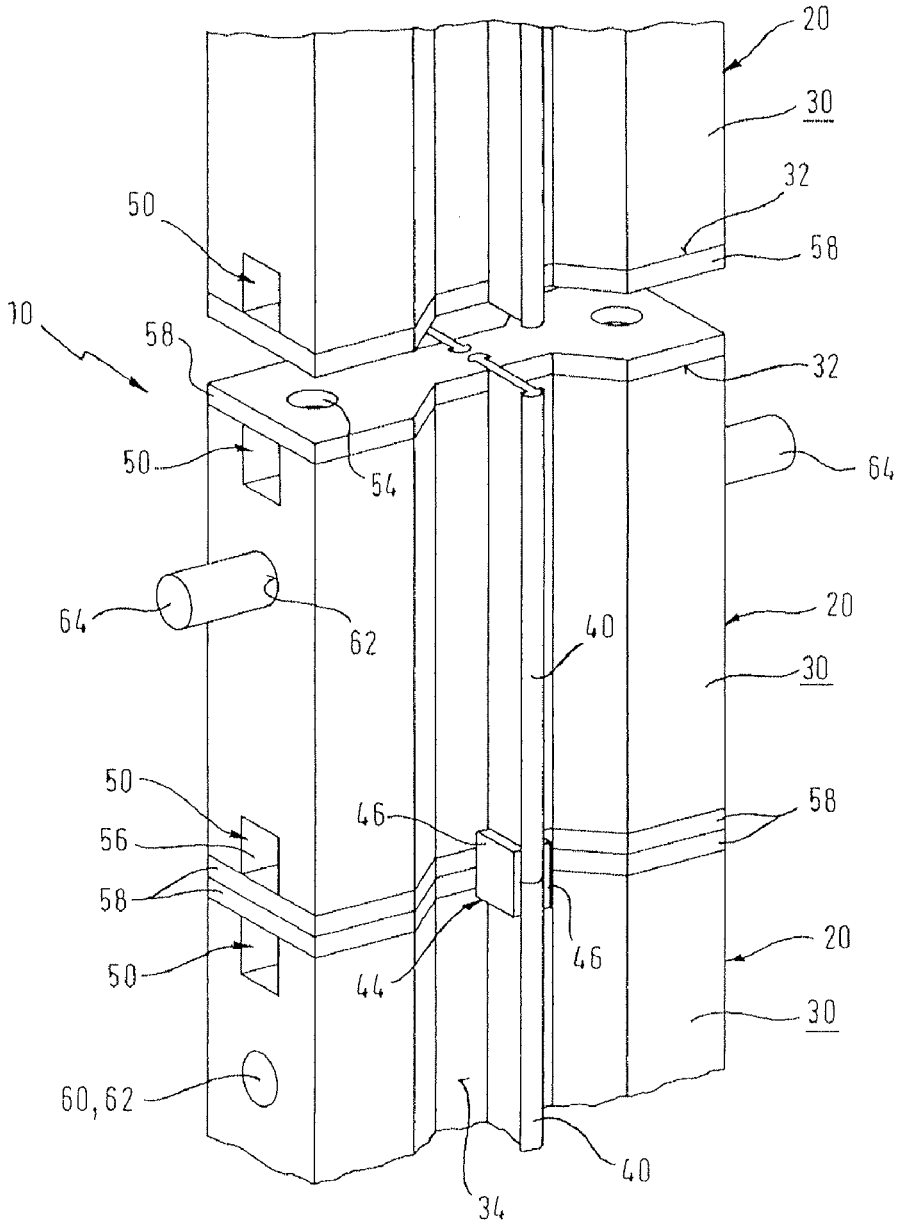
FIG. 1 shows an embodiment of a formwork element according to the invention with several formwork parts according to the invention.

The formwork element 10 shown in FIG. 1 in the assembly phase is composed of a plurality of formwork parts 20, one of which is shown completely in FIG. 1 while the formwork parts adjoining above and below are shown partly. The length of a formwork part 20 amounts to approximately 6 m.

The formwork parts 20 each comprise a base body 30 having a substantially wall-like or plate-shaped form. At the horizontal end faces 32 of the base bodies 30 of the formwork parts 20 connecting devices 50 are provided in accordance with the invention that serve for the connection of the following formwork part 20 respectively. In the illustrated example the connecting devices 50 are screw connections that are not shown in detail and are arranged in recesses 56 in the concrete base body 30. Through openings 54 the screw connections reach to the adjoining formwork parts 20 respectively. The recesses 56 are bounded at the end faces 32 of the formwork parts 20 by metal plates 58. The outer contour of these metal plates 58 corresponds to the profile of the base body 30. By particular preference the metal plates 58 are already welded to a steel reinforcement of the respective base body 30. The metal plates 58 serve in particular for fixing further sealing devices, as for example rubber plates.

The two lower formwork parts 20 in FIG. 1 are already connected to each other in a fixed manner, whereas the upper formwork part 20 shown partly only is about to be placed onto the formwork part 20 located in the centre.

In order to carry the formwork parts 20, the formwork parts 20 have a horizontal opening 62 that can serve as a holding device 60.

In the central formwork part 20 a schematically illustrated holding bar 64 is inserted into the opening 62, which can be used for transporting and handling the formwork part 20.

To ensure reliable sealing of the joints between the concrete of the formwork parts 20 that has hardened already and the concrete of the respective trench wall section that still needs to harden, a joint-sealing tape 40 is present on the longitudinal sides 34 of the formwork parts, which is cast into the base body 30.

Moreover, to additionally ensure sealing in those portions where the joint-sealing tapes 40 of adjoining formwork parts 20 make contact these portions are connected to each other in a tight manner by connecting pieces 44, as shown schematically in FIG. 1. In the depicted example the connecting pieces 44 are metal clamps 46 that are connected to one another by means of suitable fixing means, such as e.g. screw connections.

To seal the portions between the horizontal end faces 32 of adjoining formwork parts 20 these portions can be filled with a sealing compound, e.g. prior to the tightening of the connecting devices 50. However, it is particularly preferred that the formwork parts 20 are provided with seals at the horizontal end faces 32. The seals that are not depicted in FIG. 1 can be a rubber plate in particular that is fixed onto the metal plates 58 as shown in FIG. 2, for example by being screwed to the metal plates 58.

Basically, it is sufficient if a metal plate 58 is provided on the horizontal end face 32 of one formwork part 20 only.

Figure 2:
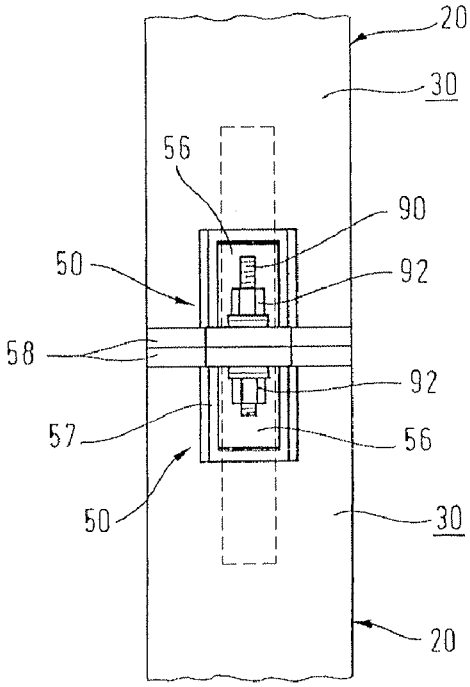
FIG. 2 shows a detail of a connecting portion of two adjoining formwork parts.

In FIG. 2 a detail of a connecting portion between two adjoining formwork parts 20 with base bodies 30 is shown. The connecting devices 50 shown there in further detail have a substantially cuboid metal box 57 that is welded on the one hand to the respective metal plates 58 and on the other hand to an internally disposed reinforcement cage of the base body 30. In a recess 56 formed by the metal box 57 a threaded bar 90 with nuts 92 is accommodated that is accessible from the outside. The threaded bar is inserted through the openings 54 shown in FIG. 1.

Mutually corresponding components are provided with the same reference signs in FIGS. 1 and 2.

By the present invention a novel formwork element composed of a plurality of formwork parts as well as a novel method for producing a trench wall in the ground are provided, which allow for considerable simplifications in the production of individual trench wall sections.

The invention claimed is:

1. A formwork element for bounding a trench wall section of a trench wall, the formwork element comprising:

a plurality of concrete formwork parts adjoining each other, each having a plate-shaped base body having top and bottom horizontal end faces, a metal plate arranged at at least one of the end faces, the metal plate having an outer contour corresponding to the profile of the base body, and a recess provided in the base body, the recess being bounded by the metal plate, wherein the formwork parts adjoin each other at their end faces, and each formwork part has a first longitudinal side for placement towards a bounding trench wall section, and a second longitudinal side opposite the first longitudinal side, the first and second longitudinal sides being perpendicular to the top and bottom horizontal end faces;

connecting devices arranged in the recesses in the base bodies and connecting adjoining formwork parts to one another at their adjoining horizontal end faces; and a joint-sealing tape arranged along at least the first longitudinal side of each of the formwork parts.

2. The formwork element according to claim 1, wherein the connecting devices connect the formwork parts to one another in a fixed manner.

3. The formwork element according to claim 2, wherein the connecting devices are screw connections.

4. The formwork element according to claim 1, further comprising connecting pieces connecting the joint-sealing tapes of adjoining and mutually connected formwork parts to each other in a tight manner.

5. The formwork element according to claim 4, wherein the connecting pieces are designed as metal clamps.

6. The formwork element according to claim 1, wherein portions between adjoining formwork parts are filled with a sealing compound.

7. The formwork element according to claim 1, further comprising a rubber plate fixed on the metal plate.

8. A formwork part for assembly with additional formwork parts identical thereto into a formwork element for bounding a trench wall section of a trench wall, the formwork part comprising:

a concrete plate-shaped base body having top and bottom horizontal end faces, a metal plate arranged at at least one horizontal end face of the base body, the metal plate having an outer contour corresponding to the profile of the base body, and a recess provided in the base body, the recess being bounded by the metal plate, and a first longitudinal side for placement towards the bounding trench wall section, and a second longitudinal side opposite the first longitudinal side, the first and second longitudinal sides being perpendicular to the top and bottom horizontal end faces;

a connecting device arranged in the recess in the base body for connecting the formwork part to an adjacent, identical formwork part at their adjoining horizontal end faces; and a joint-sealing tape arranged along at least the first longitudinal side.

9. The formwork part according to claim 8, further comprising:

a holding device providing a hold for handling the formwork part, the holding device being formed as a horizontal opening in the base body.

10. The formwork part according to claim 8, further comprising:

a seal provided on at least one horizontal end face for sealing with respect to an adjacent formwork part.

11. The formwork part according to claim 10, further comprising a rubber plate fixed on the metal plate.

12. The formwork part according to claim 8, wherein the connecting device is a screw connection.

* * * * *